US007992322B2

(12) United States Patent
Kim

(10) Patent No.: US 7,992,322 B2
(45) Date of Patent: Aug. 9, 2011

(54) DRYER HAVING INTAKE DUCT WITH HEATER INTEGRATED THEREIN

(75) Inventor: Chang Hoo Kim, Gyeyang-gu (KR)

(73) Assignee: Daewoo Electronics Corporation, Seoul (KR)

( * ) Notice: Subject to any disclaimer, the term of this patent is extended or adjusted under 35 U.S.C. 154(b) by 242 days.

(21) Appl. No.: 12/265,007

(22) Filed: Nov. 5, 2008

(65) Prior Publication Data

US 2009/0113742 A1 May 7, 2009

(30) Foreign Application Priority Data

Nov. 5, 2007 (KR) ..... 10-2007-0111999

(51) Int. Cl.
*F26B 11/02* (2006.01)

(52) U.S. Cl. ..... 34/595; 34/601; 34/602; 34/603; 34/610; 68/19.2; 68/20; 8/159; 237/12.1; 237/55; 126/85 B; 165/45; 165/54; 95/10

(58) Field of Classification Search ..... 34/595, 34/601, 602, 603; 126/85 B; 237/12.1, 55; 68/19.2, 20; 165/54, 45; 8/159; 95/10
See application file for complete search history.

(56) References Cited

U.S. PATENT DOCUMENTS 2,049,782 A * 8/1936 Smith ..... 62/106
2,114,776 A * 4/1938 Davis ..... 68/18 R
2,142,042 A * 12/1938 Bowdoin et al. ..... 34/486
2,251,960 A * 8/1941 Smith ..... 62/262
2,262,186 A * 11/1941 Lindberg ..... 34/607
2,389,433 A * 11/1945 Hough ..... 34/87
2,405,272 A * 8/1946 Smith ..... 62/73
2,405,273 A * 8/1946 Smith ..... 62/233
2,460,422 A * 2/1949 Koppel ..... 34/606
2,515,647 A * 7/1950 Hunt et al. ..... 237/9 R
2,515,650 A * 7/1950 Hunt et al. ..... 237/9 R
2,515,652 A * 7/1950 Hunt et al. ..... 237/9 R
2,604,268 A * 7/1952 Skagerberg ..... 237/1 R
2,619,737 A * 12/1952 Geldhof et al. ..... 34/604
2,686,978 A * 8/1954 Herbster ..... 34/608
2,694,867 A * 11/1954 Smith ..... 34/605
2,707,837 A * 5/1955 Paulsen et al. ..... 34/607
2,748,496 A * 6/1956 Hellyer ..... 34/603
2,798,306 A * 7/1957 Reiter ..... 34/609
2,798,307 A * 7/1957 Reiter ..... 34/610
2,807,893 A * 10/1957 Morey ..... 34/597
2,863,815 A * 12/1958 Moore et al. ..... 376/262
2,873,539 A * 2/1959 Morey ..... 34/597
2,884,710 A * 5/1959 Smith ..... 34/601
2,886,901 A * 5/1959 Whyte et al. ..... 34/601
2,893,135 A * 7/1959 Smith ..... 34/610

(Continued)

FOREIGN PATENT DOCUMENTS

EP 85118 A1 * 8/1983

(Continued)

*Primary Examiner* — Stephen M. Gravini
(74) *Attorney, Agent, or Firm* — Occhiuti Rohlicek & Tsao LLP

(57) ABSTRACT

Disclosed herein is a dryer having a heater-integrated intake duct capable of reducing thermal loss and preventing overheating of the dryer. The dryer includes a support panel having a through-hole, an intake duct communicating with the through-hole, a drum into which air flows via the through-hole, a heater disposed inside the intake duct to heat the air flowing into the drum, and a heat exchanging part transferring heat of the heated air into the drum.

8 Claims, 8 Drawing Sheets

U.S. PATENT DOCUMENTS

| | | | | | |
|---|---|---|---|---|---|
| 2,903,799 | A | * | 9/1959 | Sachaczenski | 34/527 |
| 2,949,679 | A | * | 8/1960 | MacCracken et al. | 34/598 |
| 2,958,138 | A | * | 11/1960 | Ashby | 34/601 |
| 2,958,139 | A | * | 11/1960 | Smith | 34/604 |
| 2,958,140 | A | * | 11/1960 | Smith | 34/598 |
| 2,961,776 | A | * | 11/1960 | Hughes | 34/607 |
| 2,962,218 | A | * | 11/1960 | Dibert | 237/55 |
| 2,975,528 | A | * | 3/1961 | Shewmon | 34/601 |
| 2,985,967 | A | * | 5/1961 | Pataillot et al. | 34/608 |
| 3,000,108 | A | * | 9/1961 | Jones et al. | 34/607 |
| 3,009,643 | A | * | 11/1961 | Dibert | 237/55 |
| 3,050,867 | A | * | 8/1962 | Friedman | 34/86 |
| 3,060,593 | A | * | 10/1962 | Flora et al. | 34/601 |
| 3,061,942 | A | * | 11/1962 | Scofield | 34/82 |
| 3,066,423 | A | * | 12/1962 | Solem | 34/86 |
| 3,089,327 | A | * | 5/1963 | Stilwell, Jr. | 68/139 |
| 3,103,112 | A | * | 9/1963 | Behrens et al. | 68/18 R |
| 3,106,831 | A | * | 10/1963 | Behrens | 68/12.08 |
| 3,162,032 | A | * | 12/1964 | Behrens | 68/18 F |
| 3,167,409 | A | * | 1/1965 | Brucken | 34/601 |
| 3,218,732 | A | * | 11/1965 | Alaback | 34/603 |
| 3,220,120 | A | * | 11/1965 | Ross | 34/601 |
| 3,239,947 | A | * | 3/1966 | Kenreich et al. | 34/597 |
| 3,242,589 | A | * | 3/1966 | Jacobs | 34/595 |
| 3,250,097 | A | * | 5/1966 | Czech | 68/12.09 |
| 3,256,617 | A | * | 6/1966 | Konstandt | 34/661 |
| 3,270,530 | A | * | 9/1966 | Czech | 68/18 R |
| 3,270,531 | A | * | 9/1966 | Czech | 68/18 F |
| 3,273,256 | A | * | 9/1966 | Behrens | 34/546 |
| 3,274,807 | A | * | 9/1966 | Czech | 68/12.09 |
| 3,283,548 | A | * | 11/1966 | Czech | 68/12.08 |
| 3,289,317 | A | * | 12/1966 | Lough et al. | 34/604 |
| 3,302,302 | A | * | 2/1967 | Font | 34/605 |
| 3,331,141 | A | * | 7/1967 | Jacobs et al. | 34/599 |
| 3,344,532 | A | * | 10/1967 | Bigler | 34/600 |
| 3,387,385 | A | * | 6/1968 | Mandarino, Jr. et al. | 34/596 |
| 3,398,465 | A | * | 8/1968 | Miller et al. | 34/599 |
| 3,409,997 | A | * | 11/1968 | Krolzick et al. | 34/601 |
| 3,429,056 | A | * | 2/1969 | Metzger | 34/601 |
| 3,460,267 | A | * | 8/1969 | Lorenz | 34/533 |
| 3,555,701 | A | * | 1/1971 | Hubbard | 34/602 |
| 3,570,138 | A | * | 3/1971 | Douglas et al. | 34/601 |
| 3,584,394 | A | * | 6/1971 | Grabek | 34/599 |
| 3,616,545 | A | * | 11/1971 | Jacobs | 34/599 |
| 3,616,547 | A | * | 11/1971 | Schuurink | 34/609 |
| 3,616,842 | A | * | 11/1971 | Leghorn | 164/464 |
| 3,645,010 | A | * | 2/1972 | Korekawa | 34/599 |
| 3,744,549 | A | * | 7/1973 | Buhler | 164/160.1 |
| 3,764,258 | A | * | 10/1973 | Brandt | 432/107 |
| 3,805,404 | A | * | 4/1974 | Gould | 34/75 |
| 3,815,258 | A | * | 6/1974 | Beard, Jr. | 34/602 |
| 3,844,270 | A | * | 10/1974 | Black | 126/110 R |
| 3,886,851 | A | * | 6/1975 | Berner | 454/192 |
| 3,960,196 | A | * | 6/1976 | Berner | 160/222 |
| 4,025,291 | A | * | 5/1977 | Black | 431/346 |
| 4,103,433 | A | * | 8/1978 | Taylor | 34/86 |
| 4,197,831 | A | * | 4/1980 | Black | 122/18.2 |
| 4,207,686 | A | * | 6/1980 | Daily | 34/610 |
| 4,253,917 | A | * | 3/1981 | Wang | 205/131 |
| 4,293,508 | A | * | 10/1981 | Heirbaut et al. | 264/481 |
| 4,353,348 | A | * | 10/1982 | Black | 126/91 R |
| 4,412,391 | A | * | 11/1983 | Bolognino | 34/90 |
| 4,432,336 | A | * | 2/1984 | Black | 126/91 R |
| 4,459,327 | A | * | 7/1984 | Wang | 427/183 |
| 4,516,335 | A | * | 5/1985 | Aoki et al. | 34/608 |
| 4,541,479 | A | * | 9/1985 | Bergeron, Jr. | 165/45 |
| 4,550,509 | A | * | 11/1985 | Murase | 34/604 |
| 4,602,676 | A | * | 7/1986 | Bergeron, Jr. | 165/45 |
| 4,604,054 | A | * | 8/1986 | Smith | 431/328 |
| 4,611,655 | A | * | 9/1986 | Molignoni | 165/163 |
| 4,640,022 | A | * | 2/1987 | Suzuki et al. | 34/552 |
| 4,651,805 | A | * | 3/1987 | Bergeron, Jr. | 165/45 |
| 4,689,896 | A | * | 9/1987 | Narang | 34/82 |
| 4,700,495 | A | * | 10/1987 | Drews et al. | 34/603 |
| 4,746,495 | A | * | 5/1988 | Mingaud et al. | 422/631 |
| 4,825,560 | A | * | 5/1989 | Nakamura et al. | 34/609 |
| 4,891,892 | A | * | 1/1990 | Narang | 34/86 |
| 4,899,464 | A | * | 2/1990 | Carr et al. | 34/604 |
| 4,989,347 | A | * | 2/1991 | Kretchman | 34/607 |
| 5,042,171 | A | * | 8/1991 | Obata et al. | 34/604 |
| 5,050,259 | A | * | 9/1991 | Tsubaki et al. | 8/159 |
| 5,107,606 | A | * | 4/1992 | Tsubaki et al. | 34/596 |
| 5,111,673 | A | * | 5/1992 | Kadoya et al. | 68/12.04 |
| 5,127,169 | A | * | 7/1992 | Ellingson | 34/601 |
| 5,152,077 | A | * | 10/1992 | Liang | 34/77 |
| 5,172,490 | A | * | 12/1992 | Tatsumi et al. | 34/488 |
| 5,187,879 | A | * | 2/1993 | Holst | 34/261 |
| 5,212,969 | A | * | 5/1993 | Tsubaki et al. | 68/19.2 |
| 5,241,817 | A | * | 9/1993 | George, Jr. | 60/39.182 |
| 5,245,764 | A | * | 9/1993 | Sung | 34/550 |
| 5,253,703 | A | * | 10/1993 | Master et al. | 165/82 |
| 5,258,306 | A | * | 11/1993 | Goldfarb | 435/290.2 |
| 5,263,267 | A | * | 11/1993 | Buttner et al. | 34/519 |
| 5,315,765 | A | * | 5/1994 | Holst et al. | 34/260 |
| 5,321,897 | A | * | 6/1994 | Holst et al. | 34/260 |
| 5,347,727 | A | * | 9/1994 | Kim | 34/491 |
| 5,421,103 | A | * | 6/1995 | Wunderlich | 34/599 |
| 5,477,623 | A | * | 12/1995 | Tomizawa et al. | 34/58 |
| 5,548,908 | A | * | 8/1996 | Torborg et al. | 34/601 |
| 5,551,414 | A | * | 9/1996 | Quick | 126/85 B |
| 5,555,647 | A | * | 9/1996 | Torborg et al. | 34/601 |
| 5,557,859 | A | * | 9/1996 | Baron | 34/378 |
| 5,701,684 | A | * | 12/1997 | Johnson | 34/595 |
| 5,709,041 | A | * | 1/1998 | Tarplee | 34/595 |
| 5,768,730 | A | * | 6/1998 | Matsumoto et al. | 8/159 |
| 5,771,604 | A | * | 6/1998 | Wunderlich et al. | 34/603 |
| 5,887,456 | A | * | 3/1999 | Tanigawa et al. | 68/20 |
| RE36,539 | E | * | 2/2000 | Quick | 126/85 B |
| 6,032,494 | A | * | 3/2000 | Tanigawa et al. | 68/12.06 |
| 6,098,312 | A | * | 8/2000 | Tuggle | 34/607 |
| 6,237,208 | B1 | * | 5/2001 | Meeth | 29/403.1 |
| 6,355,091 | B1 | * | 3/2002 | Felber et al. | 95/10 |
| 6,370,798 | B1 | * | 4/2002 | Gonzalez, Sr. | 34/595 |
| 6,434,857 | B1 | * | 8/2002 | Anderson et al. | 34/595 |
| 6,550,687 | B2 | * | 4/2003 | Lyons et al. | 237/55 |
| 6,575,228 | B1 | * | 6/2003 | Ragland et al. | 165/54 |
| 6,618,958 | B2 | * | 9/2003 | Myung et al. | 34/602 |
| 6,643,953 | B2 | * | 11/2003 | Song et al. | 34/604 |
| 6,647,643 | B2 | * | 11/2003 | Song et al. | 34/595 |
| 6,663,011 | B1 | * | 12/2003 | Entleutner | 237/12.1 |
| 6,678,969 | B1 | * | 1/2004 | Hong | 34/595 |
| 6,692,213 | B1 | * | 2/2004 | Butler | 414/412 |
| 6,698,107 | B2 | * | 3/2004 | Song et al. | 34/595 |
| 6,751,888 | B2 | * | 6/2004 | Lueckenbach | 34/595 |
| 6,796,454 | B1 | * | 9/2004 | Matthews et al. | 221/197 |
| 6,829,845 | B2 | * | 12/2004 | Han et al. | 34/603 |
| 6,874,250 | B2 | * | 4/2005 | Prajescu et al. | 34/606 |
| 6,904,703 | B2 | * | 6/2005 | Naganawa et al. | 34/596 |
| 6,908,039 | B2 | * | 6/2005 | Lyons et al. | 237/55 |
| 6,928,752 | B2 | * | 8/2005 | Johnson et al. | 34/595 |
| 6,944,944 | B1 | * | 9/2005 | Craythorn et al. | 29/798 |
| 6,968,632 | B2 | * | 11/2005 | Guinibert et al. | 34/602 |
| 6,988,545 | B2 | * | 1/2006 | Good | 165/173 |
| 7,017,282 | B2 | * | 3/2006 | Pyo et al. | 34/596 |
| 7,020,985 | B2 | * | 4/2006 | Casey et al. | 34/595 |
| 7,032,326 | B2 | * | 4/2006 | Hong | 34/602 |
| 7,036,243 | B2 | * | 5/2006 | Doh et al. | 34/595 |
| 7,062,863 | B2 | * | 6/2006 | Chung | 34/596 |
| 7,065,904 | B2 | * | 6/2006 | Lee et al. | 34/601 |
| 7,065,905 | B2 | * | 6/2006 | Guinibert et al. | 34/603 |
| 7,069,669 | B2 | * | 7/2006 | Park et al. | 34/603 |
| 7,093,377 | B2 | * | 8/2006 | Doh et al. | 34/596 |
| 7,093,378 | B2 | * | 8/2006 | Jeong et al. | 34/601 |
| 7,117,827 | B1 | * | 10/2006 | Hinderks | 123/43 R |
| 7,121,018 | B2 | * | 10/2006 | Lee | 34/595 |
| 7,140,123 | B2 | * | 11/2006 | Lee | 34/601 |
| 7,178,264 | B2 | * | 2/2007 | Kim | 34/596 |
| 7,194,824 | B2 | * | 3/2007 | Wang | 34/602 |
| 7,204,039 | B2 | * | 4/2007 | Cho et al. | 34/596 |
| 7,220,365 | B2 | * | 5/2007 | Qu et al. | 252/70 |
| 7,225,562 | B2 | * | 6/2007 | Guinibert et al. | 34/601 |
| 7,228,647 | B2 | * | 6/2007 | Hong | 34/596 |
| 7,251,905 | B2 | * | 8/2007 | Doh et al. | 34/603 |
| 7,325,332 | B2 | * | 2/2008 | Chung et al. | 34/602 |
| 7,325,333 | B2 | * | 2/2008 | Tadano et al. | 34/604 |
| 7,340,847 | B2 | * | 3/2008 | Kim | 34/601 |
| 7,340,849 | B2 | * | 3/2008 | Kim | 34/602 |

| | | | | |
|---|---|---|---|---|
| 7,347,009 | B2 * | 3/2008 | Ahn et al. | 34/607 |
| 7,406,780 | B2 * | 8/2008 | Doh et al. | 34/606 |
| 7,422,424 | B2 * | 9/2008 | Kark | 425/224 |
| 7,434,334 | B2 * | 10/2008 | Hwang et al. | 34/606 |
| 7,438,027 | B1 * | 10/2008 | Hinderks | 123/43 R |
| 7,467,483 | B2 * | 12/2008 | Guinibert et al. | 34/601 |
| 7,487,583 | B2 * | 2/2009 | Craythorn et al. | 29/809 |
| 7,506,458 | B2 * | 3/2009 | Lee et al. | 34/601 |
| 7,523,564 | B2 * | 4/2009 | Doh | 34/601 |
| 7,526,879 | B2 * | 5/2009 | Bae et al. | 34/596 |
| 7,543,396 | B2 * | 6/2009 | Nishino et al. | 34/606 |
| 7,552,545 | B2 * | 6/2009 | Crawford et al. | 34/600 |
| 7,559,156 | B2 * | 7/2009 | Renzo | 34/595 |
| 7,562,467 | B2 * | 7/2009 | Doh | 34/601 |
| 7,591,082 | B2 * | 9/2009 | Lee et al. | 34/600 |
| 7,661,391 | B2 * | 2/2010 | Sia | 119/346 |
| 7,699,051 | B2 * | 4/2010 | Gagas et al. | 126/299 D |
| 7,836,877 | B2 * | 11/2010 | Gagas et al. | 126/299 D |
| 7,849,579 | B2 * | 12/2010 | Craythorn et al. | 29/524.1 |
| 2001/0042610 | A1 * | 11/2001 | Lyons et al. | 165/47 |
| 2003/0000104 | A1 * | 1/2003 | Song et al. | 34/595 |
| 2003/0000105 | A1 * | 1/2003 | Song et al. | 34/595 |
| 2003/0000106 | A1 * | 1/2003 | Anderson et al. | 34/598 |
| 2003/0037460 | A1 * | 2/2003 | Song et al. | 34/595 |
| 2003/0056393 | A1 * | 3/2003 | Lee et al. | 34/595 |
| 2003/0066638 | A1 * | 4/2003 | Qu et al. | 165/186 |
| 2003/0098358 | A1 * | 5/2003 | Lyons et al. | 237/55 |
| 2003/0136022 | A1 * | 7/2003 | Myung et al. | 34/595 |
| 2004/0010936 | A1 * | 1/2004 | Han | 34/595 |
| 2004/0010937 | A1 * | 1/2004 | Naganawa et al. | 34/595 |
| 2004/0018228 | A1 * | 1/2004 | Fischell et al. | 424/450 |
| 2004/0060196 | A1 * | 4/2004 | Lueckenbach | 34/595 |
| 2004/0060197 | A1 * | 4/2004 | Jeong et al. | 34/595 |
| 2004/0098878 | A1 * | 5/2004 | Park et al. | 34/595 |
| 2004/0103556 | A1 * | 6/2004 | Bang | 34/595 |
| 2004/0118013 | A1 * | 6/2004 | Kohlman et al. | 34/595 |
| 2004/0123486 | A1 * | 7/2004 | Hameed et al. | 34/595 |
| 2004/0134092 | A1 * | 7/2004 | Hong et al. | 34/595 |
| 2004/0134093 | A1 * | 7/2004 | Han | 34/595 |
| 2004/0163276 | A1 * | 8/2004 | Han et al. | 34/603 |
| 2004/0168343 | A1 * | 9/2004 | Park | 34/606 |
| 2004/0168344 | A1 * | 9/2004 | Park | 34/606 |
| 2004/0188058 | A1 * | 9/2004 | Good | 165/4 |
| 2004/0194339 | A1 * | 10/2004 | Johnson et al. | 34/595 |
| 2004/0200093 | A1 * | 10/2004 | Wunderlin et al. | 34/606 |
| 2004/0216327 | A1 * | 11/2004 | Chung | 34/607 |
| 2004/0237338 | A1 * | 12/2004 | Rump et al. | 34/607 |
| 2004/0261288 | A1 * | 12/2004 | Beyerle et al. | 34/602 |
| 2005/0016015 | A1 * | 1/2005 | Prajescu et al. | 34/601 |
| 2005/0044744 | A1 * | 3/2005 | Tadano et al. | 34/596 |
| 2005/0050764 | A1 * | 3/2005 | Jeong et al. | 34/601 |
| 2005/0050765 | A1 * | 3/2005 | Park et al. | 34/603 |
| 2005/0076535 | A1 * | 4/2005 | Guinibert et al. | 34/601 |
| 2005/0086832 | A1 * | 4/2005 | Declos | 34/604 |
| 2005/0097772 | A1 * | 5/2005 | Lee | 34/601 |
| 2005/0102853 | A1 * | 5/2005 | Wang | 34/602 |
| 2005/0108893 | A1 * | 5/2005 | Hwang et al. | 34/603 |
| 2005/0115104 | A1 * | 6/2005 | Guinibert et al. | 34/601 |
| 2005/0120585 | A1 * | 6/2005 | Lee et al. | 34/602 |
| 2005/0126035 | A1 * | 6/2005 | Lee et al. | 34/602 |
| 2005/0132601 | A1 * | 6/2005 | Doh | 34/601 |
| 2005/0132602 | A1 * | 6/2005 | Jeong et al. | 34/602 |
| 2005/0132604 | A1 * | 6/2005 | Hong et al. | 34/603 |
| 2005/0138831 | A1 * | 6/2005 | Lee | 34/73 |
| 2005/0138836 | A1 * | 6/2005 | Hwang et al. | 34/603 |
| 2005/0155250 | A1 * | 7/2005 | Chung et al. | 34/602 |
| 2005/0155251 | A1 * | 7/2005 | Lee | 34/604 |
| 2005/0166421 | A1 * | 8/2005 | Doh et al. | 34/603 |
| 2005/0217139 | A1 * | 10/2005 | Hong | 34/604 |
| 2005/0223592 | A1 * | 10/2005 | Hong | 34/601 |
| 2005/0235519 | A1 * | 10/2005 | Chung | 34/607 |
| 2005/0252029 | A1 * | 11/2005 | Kim | 34/596 |
| 2005/0252030 | A1 * | 11/2005 | Park et al. | 34/601 |
| 2005/0252031 | A1 * | 11/2005 | Park et al. | 34/601 |
| 2005/0252032 | A1 * | 11/2005 | Park et al. | 34/604 |
| 2005/0268483 | A1 * | 12/2005 | Park et al. | 34/603 |
| 2005/0284910 | A1 * | 12/2005 | Craythorn et al. | 227/112 |
| 2006/0086001 | A1 * | 4/2006 | Jeong et al. | 34/606 |
| 2006/0101666 | A1 * | 5/2006 | Cho et al. | 34/596 |
| 2006/0112590 | A1 * | 6/2006 | Kim | 34/603 |
| 2006/0117596 | A1 * | 6/2006 | Kim et al. | 34/607 |
| 2006/0137208 | A1 * | 6/2006 | Lee et al. | 34/130 |
| 2006/0196077 | A1 * | 9/2006 | Choi | 34/602 |
| 2006/0218817 | A1 * | 10/2006 | Lee | 34/604 |
| 2006/0236560 | A1 * | 10/2006 | Doh et al. | 34/596 |
| 2006/0254082 | A1 * | 11/2006 | Kim | 34/595 |
| 2006/0260150 | A1 * | 11/2006 | Doh | 34/601 |
| 2006/0265899 | A1 * | 11/2006 | Renzo | 34/603 |
| 2006/0278215 | A1 * | 12/2006 | Gagas et al. | 126/299 D |
| 2006/0278216 | A1 * | 12/2006 | Gagas et al. | 126/299 D |
| 2006/0288608 | A1 * | 12/2006 | Carow et al. | 34/604 |
| 2007/0006485 | A1 * | 1/2007 | Kim | 34/603 |
| 2007/0104817 | A1 * | 5/2007 | Kark | 425/373 |
| 2007/0151119 | A1 * | 7/2007 | Heyder et al. | 34/601 |
| 2007/0186440 | A1 * | 8/2007 | Guinibert et al. | 34/603 |
| 2007/0199207 | A1 * | 8/2007 | Oh et al. | 34/602 |
| 2007/0209228 | A1 * | 9/2007 | Meerpohl et al. | 34/595 |
| 2007/0220776 | A1 * | 9/2007 | Guinibert et al. | 34/603 |
| 2007/0256322 | A1 * | 11/2007 | Kim et al. | 34/603 |
| 2008/0022551 | A1 * | 1/2008 | Banta et al. | 34/602 |
| 2008/0022552 | A1 * | 1/2008 | Forget | 34/602 |
| 2008/0029081 | A1 * | 2/2008 | Gagas et al. | 126/299 D |
| 2008/0034607 | A1 * | 2/2008 | Ahn et al. | 34/130 |
| 2008/0034608 | A1 * | 2/2008 | Ahn et al. | 34/134 |
| 2008/0060218 | A1 * | 3/2008 | Doh | 34/601 |
| 2008/0087762 | A1 * | 4/2008 | Holloman et al. | 244/30 |
| 2008/0110041 | A1 * | 5/2008 | Ehlers | 34/487 |
| 2008/0110044 | A1 * | 5/2008 | Ehlers | 34/524 |
| 2008/0113609 | A1 * | 5/2008 | Ehlers | 454/241 |
| 2008/0141558 | A1 * | 6/2008 | Bae et al. | 34/595 |
| 2008/0141921 | A1 * | 6/2008 | Hinderks | 114/274 |
| 2008/0178819 | A1 * | 7/2008 | Sia et al. | 119/300 |
| 2008/0196268 | A1 * | 8/2008 | Jung et al. | 34/603 |
| 2008/0244922 | A1 * | 10/2008 | Kim et al. | 34/134 |
| 2008/0289212 | A1 * | 11/2008 | Moon et al. | 34/267 |
| 2009/0049872 | A1 * | 2/2009 | Noro et al. | 68/18 C |
| 2009/0064534 | A1 * | 3/2009 | LeClerc | 34/603 |
| 2009/0071033 | A1 * | 3/2009 | Ahn et al. | 34/595 |
| 2009/0083991 | A1 * | 4/2009 | Prajescu | 34/601 |
| 2009/0083992 | A1 * | 4/2009 | Prajescu et al. | 34/601 |
| 2009/0100702 | A1 * | 4/2009 | Fair | 34/487 |
| 2009/0113742 | A1 * | 5/2009 | Kim | 34/132 |
| 2009/0113743 | A1 * | 5/2009 | Kim | 34/132 |
| 2009/0158616 | A1 * | 6/2009 | Ricklefs et al. | 34/601 |
| 2009/0158617 | A1 * | 6/2009 | Ricklefs et al. | 34/603 |
| 2009/0212062 | A1 * | 8/2009 | Craythorn et al. | 221/1 |
| 2010/0132622 | A1 * | 6/2010 | Sia | 119/300 |
| 2010/0139572 | A1 * | 6/2010 | Sia et al. | 119/346 |
| 2011/0049176 | A1 * | 3/2011 | Craythorn et al. | 221/1 |

FOREIGN PATENT DOCUMENTS

| | | | | |
|---|---|---|---|---|
| GB | 2265699 | A | * | 10/1993 |
| JP | 54084654 | A | * | 7/1979 |
| JP | 54084655 | A | * | 7/1979 |
| JP | 54108060 | A | * | 8/1979 |
| JP | 61049924 | A | * | 3/1986 |
| JP | 02046896 | A | * | 2/1990 |
| JP | 04200590 | A | * | 7/1992 |
| JP | 04240497 | A | * | 8/1992 |
| JP | 06026674 | A | * | 2/1994 |
| JP | 06134194 | A | * | 5/1994 |
| JP | 06137759 | A | * | 5/1994 |
| JP | 06218197 | A | * | 8/1994 |
| JP | 06300201 | A | * | 10/1994 |
| JP | 09028997 | A | * | 2/1997 |
| JP | 09056991 | A | * | 3/1997 |
| JP | 10033896 | A | * | 2/1998 |
| JP | 11142579 | A | * | 5/1999 |

* cited by examiner

DRYER HAVING INTAKE DUCT WITH HEATER INTEGRATED THEREIN

CROSS-REFERENCE TO RELATED APPLICATIONS

This application claims priority to Korean Application No. 10-2007-0111999 filed on Nov. 5, 2007, the content of which is hereby incorporated by reference in its entirety.

BACKGROUND OF THE INVENTION

1. Field of the Invention

The present invention relates to a dryer, and more particularly to a dryer that has a heater-integrated intake duct capable of reducing thermal loss and preventing overheating of the dryer.

2. Description of the Related Art

FIG. 1 is a schematic sectional view showing a flow passage of a conventional dryer, and FIG. 2 is a partially cut-away perspective view of the conventional dryer.

Referring to FIGS. 1 and 2, the conventional dryer includes a case 2 constituting an outer appearance of the dryer, a drum 12 rotatably disposed inside the case 2, a heater 18 disposed at a lower side of the case 2 to heat air introduced into the case, an intake duct 20 guiding air heated by the heater 18 to the rear of the drum 12, an exhaust mechanism 22 for discharging air to the outside of the case 2, a ventilation fan (not shown) provided to the exhaust mechanism 22, and a motor (not shown) and a fan belt 40 disposed at the lower side of the case 2 to drive the drum 12 and the ventilation fan. Further, the drum 12 has lifters 11 coupled to an inner surface thereof to lift and drop laundry during a drying operation.

The exhaust mechanism 22 includes a lint duct 25 defining a flow passage of air discharged from the drum 12 and having a filter 24 to separate foreign matter from air flowing through the lint duct 25, a fan housing 26 communicating with the lint duct 25 and surrounding the ventilation fan 30, and an exhaust duct 27 having one end communicating with the ventilation fan and the other end disposed outside the case 2.

Operation of the conventional dryer will be described below.

First, when the dryer is operated with laundry received in the drum 12, the drum 12 and the ventilation fan are rotated, and the heater 18 is operated.

While the drum 12 is rotated, the laundry received in the drum 12 is lifted by the lifters 11 and then falls down inside the drum 12. Further, while being sucked into the drum 12 through the heater 18 by a ventilation force caused by rotation of the ventilation fan, external air is changed into high-temperature low-humidity air by the heater 18 and flows into the drum 12 through the intake duct 20.

Inside the drum 12, high-temperature low-humidity air having flown into the drum 12 dries the laundry, changes into low-temperature high-humidity air, and is finally discharged to the outside of the dryer through the exhaust duct 27.

In the conventional dryer, however, since the heater is accommodated in a separate tube extending from the intake duct and located inside the cabinet, making it difficult to reduce the distance between the heater and the drum to a predetermined distance or less, the air heated by the heater experiences thermal loss while flowing into the drum.

Further, since the drive motor and the heater, both of which are likely to overheat, are all disposed at the lower side of the cabinet in the conventional dryer, the interior of the dryer can be overheated to cause malfunction or damage of the dryer.

Therefore, there is a need for an improved dryer that overcomes such problems of the conventional dryer.

SUMMARY OF THE INVENTION

The present invention is conceived to solve the problems of the conventional techniques, and an aspect of the present invention is to provide a dryer that has a heater-integrated intake duct capable of reducing thermal loss and preventing overheating of the dryer.

In accordance with the present invention, the above and other aspects can be accomplished by the provision of a dryer having a heater-integrated intake duct, the dryer including: a support panel having a through-hole; an intake duct communicating with the through-hole; a drum into which air flows via the through-hole; a heater disposed inside the intake duct to heat the air flowing into the drum; and a heat exchanging part transferring heat of the heated air into the drum.

The heat exchanging part may include a ledge protruding into the intake duct.

The ledge may be formed to define a space between the intake duct and the support panel.

The heat exchanging part may further include a conduction hole formed in the support panel so as to correspond to the ledge.

The dryer may further include a cooling hole formed between the heater and the heat exchanging part to allow air outside the intake duct to be supplied into the drum through the cooling hole.

One end of the heat exchanging part may be disposed adjacent the other end of the heater. The one end of the heat exchanging part may be disposed parallel to the other end of the heater.

One side of the intake duct may be disposed outside the cabinet. The one side of the intake duct may be disposed on a lateral side of the cabinet.

The heater may be disposed on a lateral side of the cabinet. The dryer may further include a drive motor disposed at a lower side of the cabinet.

BRIEF DESCRIPTION OF THE DRAWINGS

The above and other aspects, features and advantages of the present invention will become apparent from the following description of exemplary embodiments given in conjunction with the accompanying drawings, in which.

DETAILED DESCRIPTION OF THE INVENTION

Exemplary embodiments of a dryer having a heater-integrated intake duct according to the present invention will be described in detail with reference to the accompanying drawings. Herein, the dryer having the heater-integrated intake duct will be described as an example for convenience of description. The drawings may be exaggerated in thickness of lines or scale of components for the purpose of descriptive convenience and clarity only. Furthermore, terms used herein should be defined in consideration of functions of components of the present invention and thus can be changed according to the custom or intention of users or operators. Therefore, definition of such terms should be determined according to overall disclosures set forth herein.

Figure 1:
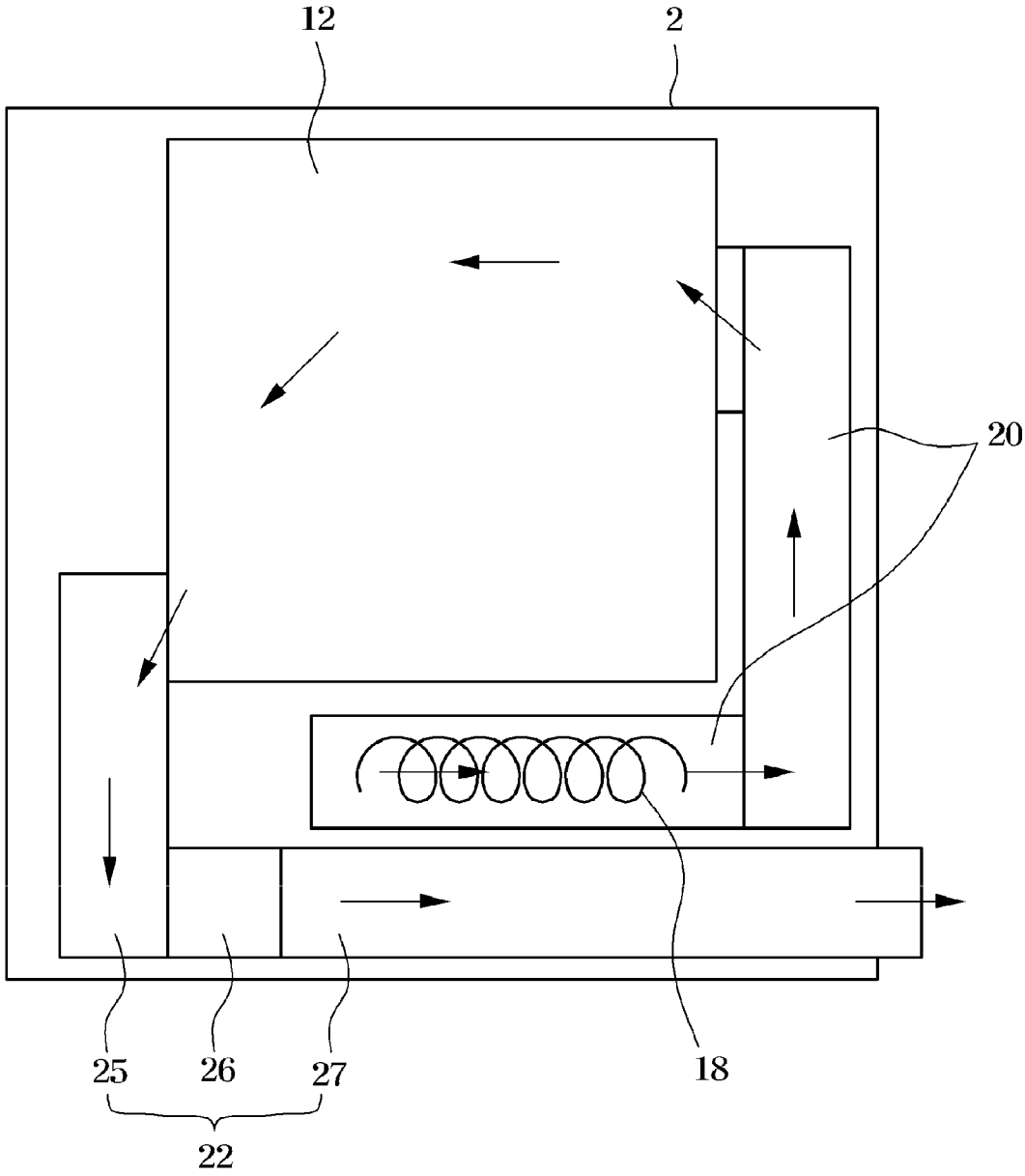
FIG. 1 PRIOR ART
FIG. 1 is a schematic sectional view showing a flow passage of a conventional dryer.
Figure 2:
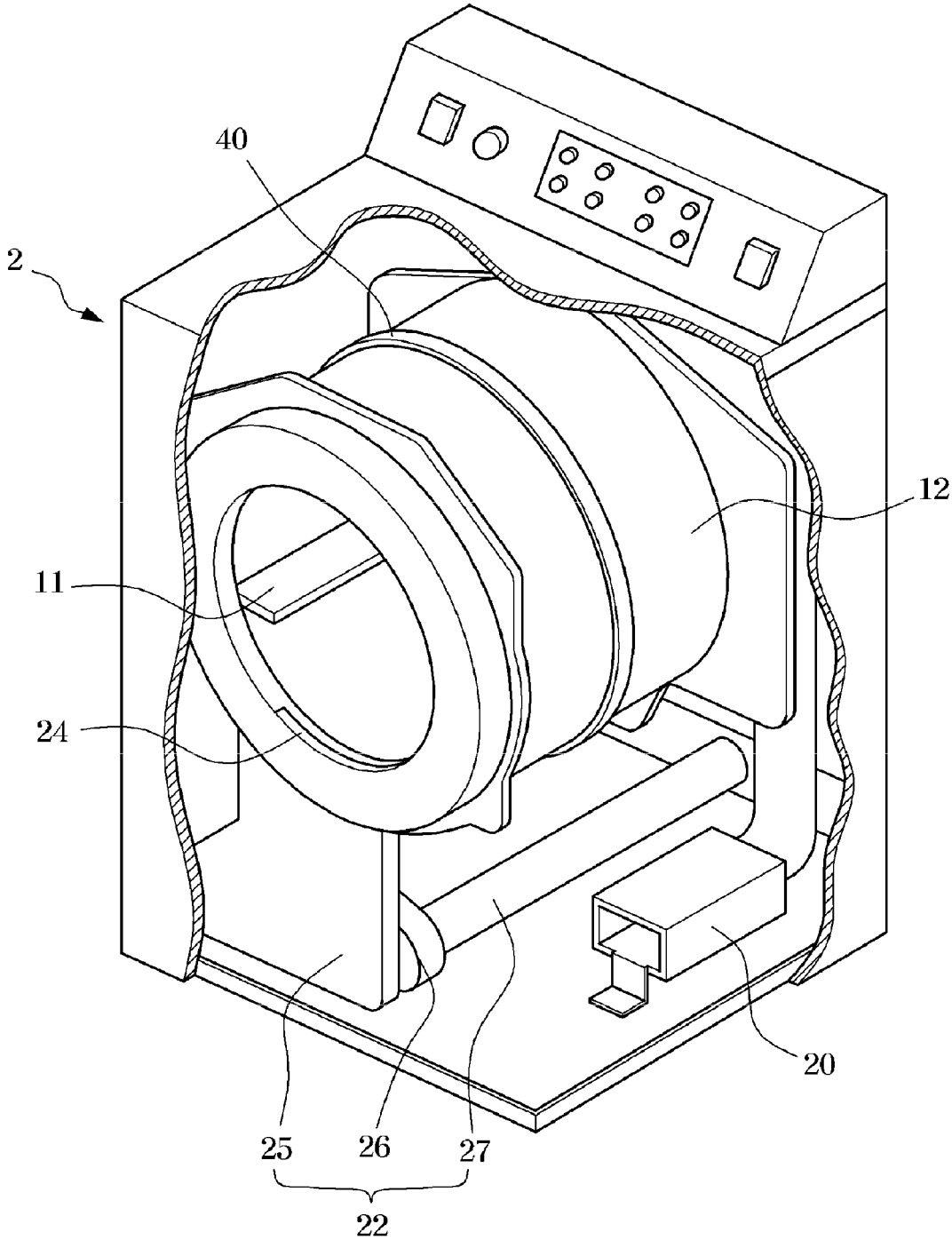
FIG. 2 PRIOR ART
FIG. 2 is a partially cut-away perspective view of the conventional dryer.
Figure 3:
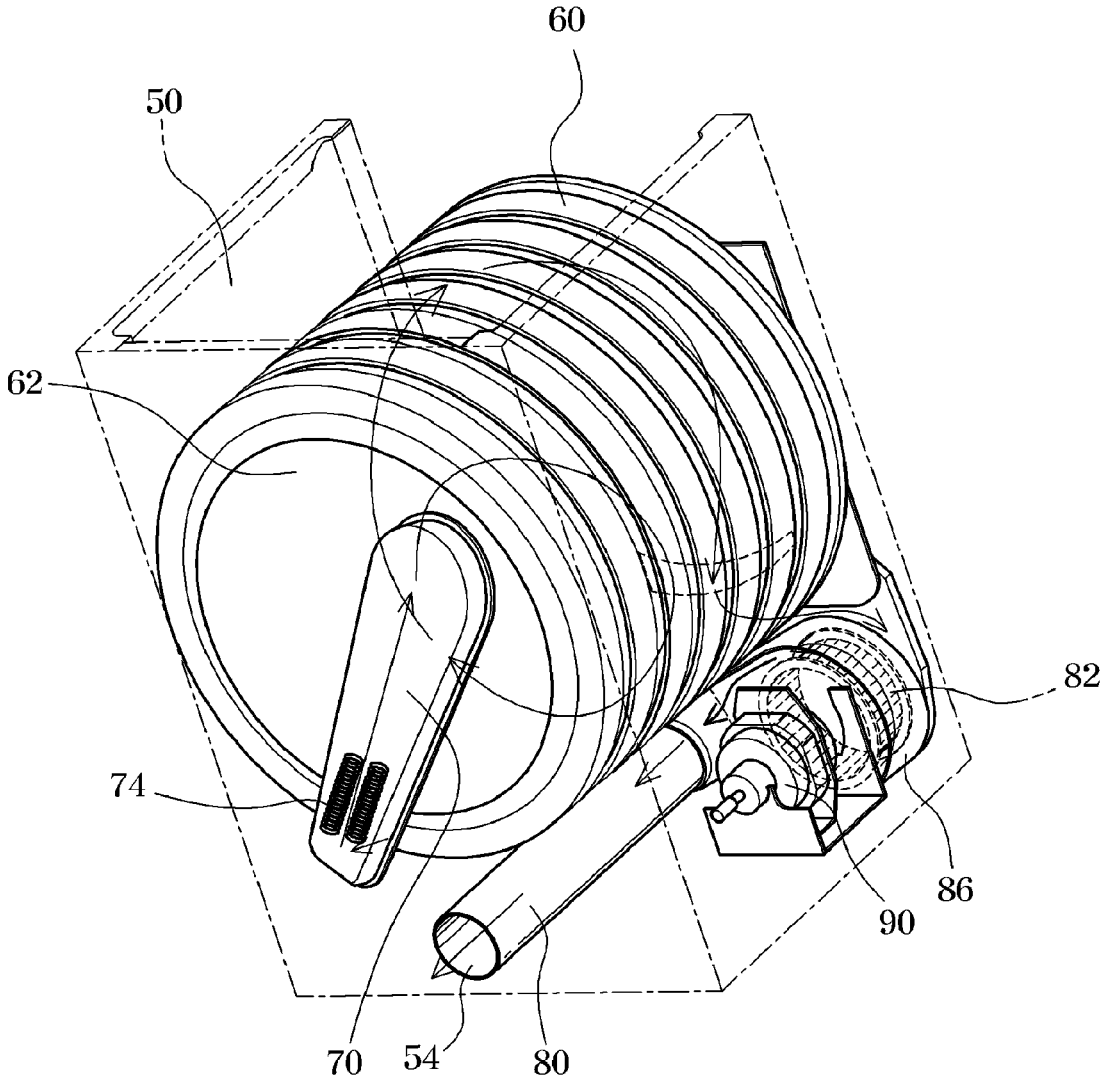
FIG. 3 is a rear perspective view of a dryer having a heater-integrated intake duct according to one embodiment of the present invention.
Figure 4:
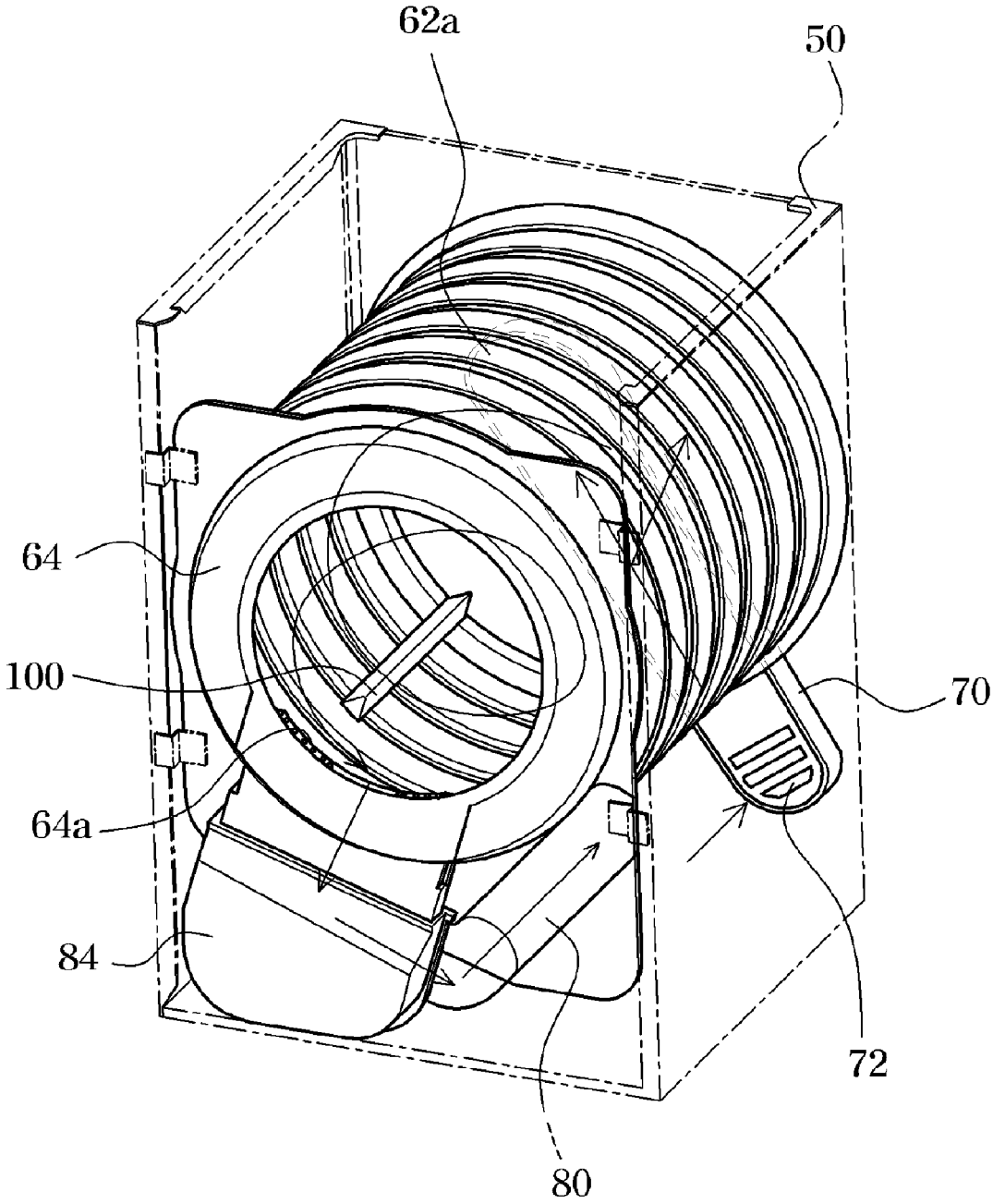
FIG. 4 is a front perspective view of the dryer according to the embodiment of the present invention.
Figure 5:
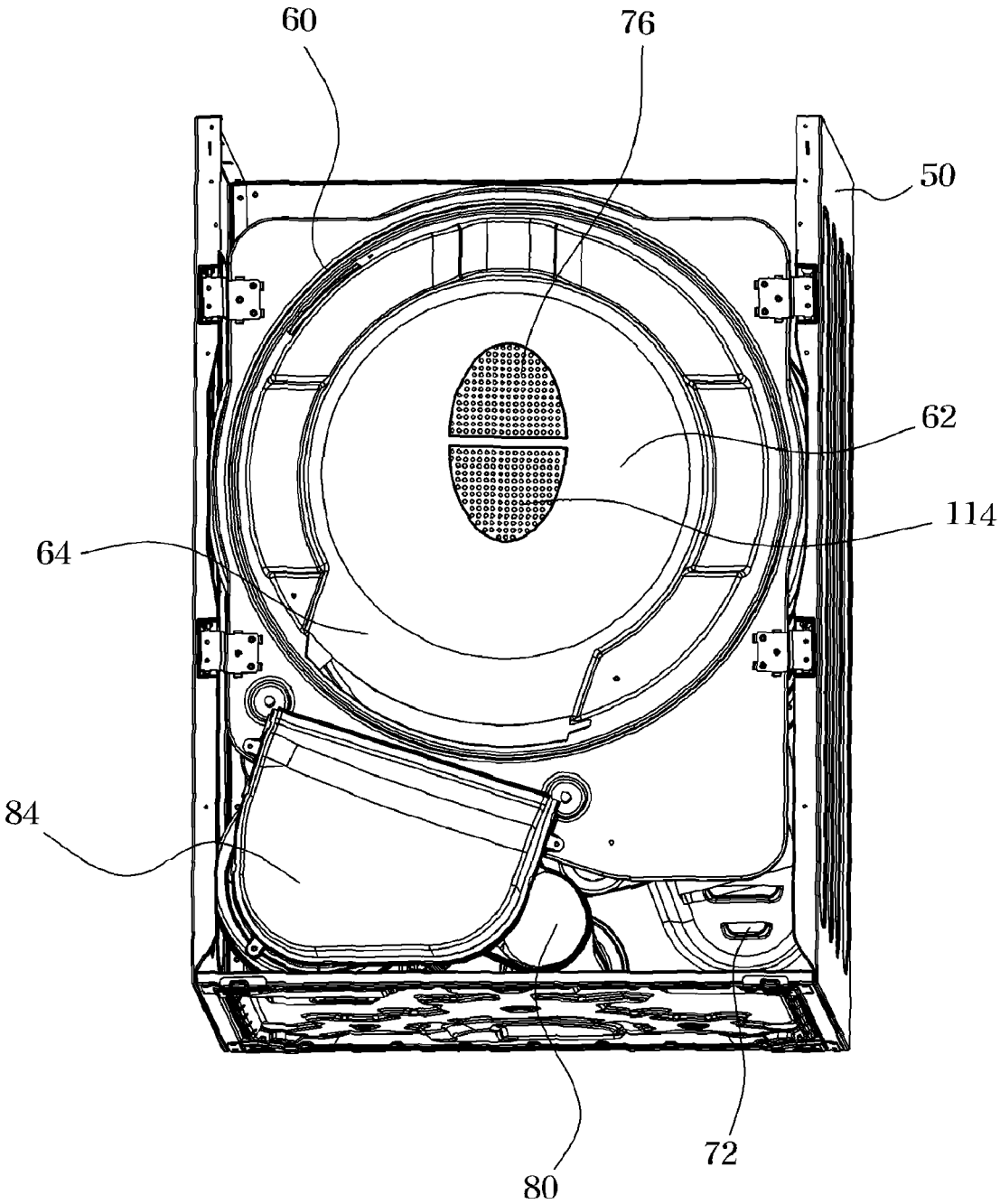
FIG. 5 is a front perspective view of the dryer according to the embodiment of the present invention, illustrating a support panel of the dryer.
Figure 6:
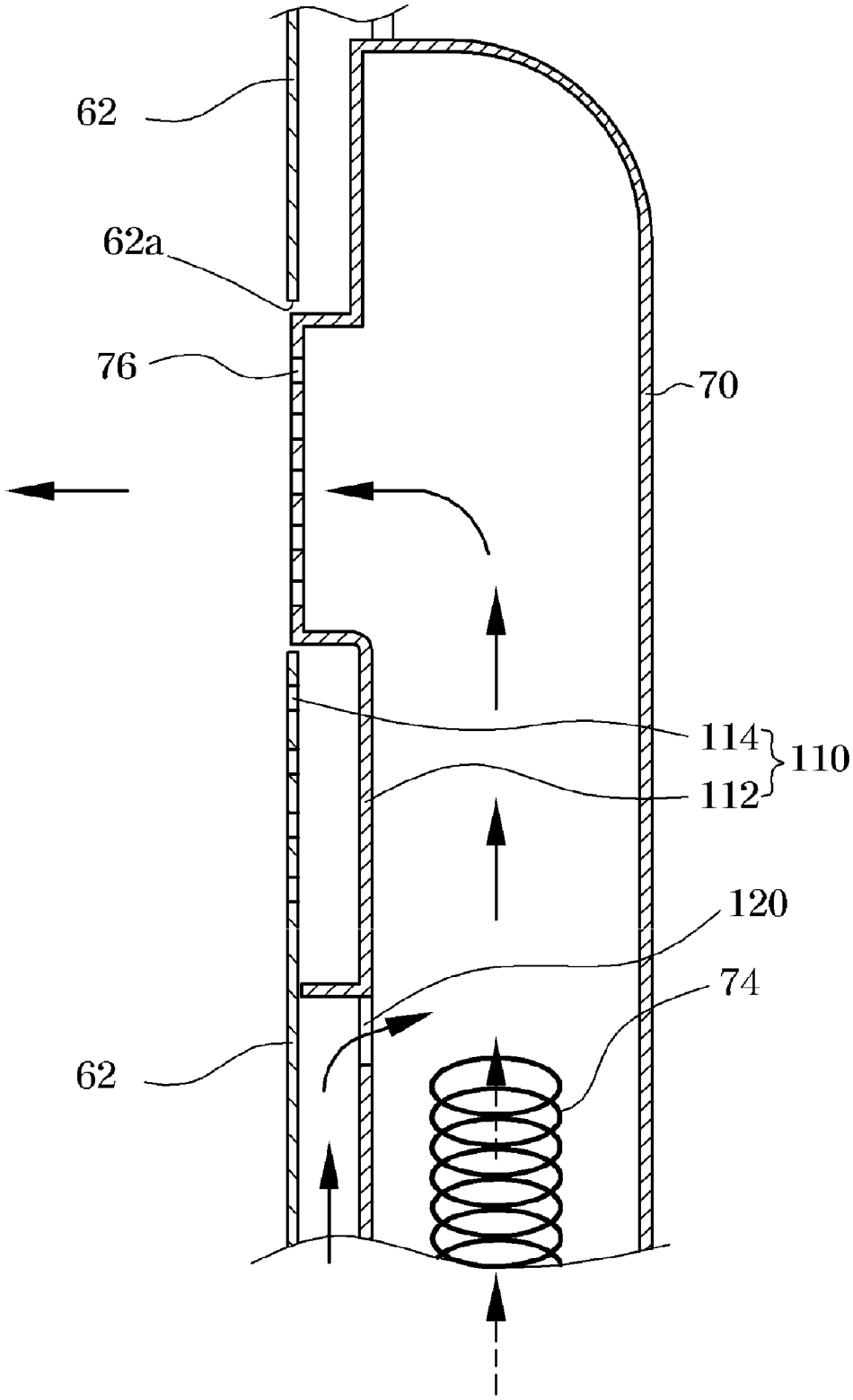
FIG. 6 is a sectional view of the intake duct of the dryer according to the embodiment of the present invention.

FIG. 3 is a rear perspective view of a dryer having a heater-integrated intake duct according to one embodiment of the present invention, FIG. 4 is a front perspective view of the dryer according to the embodiment of the present invention, FIG. 5 is a front perspective view of the dryer according to the embodiment of the present invention, illustrating a support panel of the dryer, and FIG. 6 is a sectional view of the intake duct of the dryer according to the embodiment of the present invention.

Referring to FIGS. 3 to 6, the dryer according to one embodiment of the present invention includes a cabinet 50 having an air vent 54, a drum 60 rotatably disposed inside the cabinet 50 to receive laundry, a support panel 62 supporting the drum 60 and having a through hole 62*a* formed therein, a plurality of lifters 100 formed on an inner surface of the drum 60 to lift and drop the laundry rotating inside the drum 60, an intake duct 70 disposed inside the cabinet 50 to guide air into the drum 60, a heater 74 disposed inside the intake duct 70, an exhaust fan 82 disposed between the drum 60 and the air vent 54, an exhaust duct 80 disposed between the exhaust fan 82 and the air vent 54, a drive motor 90 for driving the exhaust fan 82, and a heat exchanging part 110 for transferring heat of the heated air flowing through the intake duct 70 into the drum 60. The heat exchanging part 110 may be provided to at least one of the intake duct 70 and the support panel 62.

When power is applied to the drive motor 90, the exhaust fan 82 is rotated to circulate air. Then, air inside the cabinet 50 is heated by the heater 100 while passing through the heater 100, and flows into the drum 60 through the intake duct 70 to dry or sterilize laundry in the drum 60. While flowing into the drum 60 through the intake duct 70, the air comes into contact with the heat exchanging part 110, which in turn transfers heat from the air into the drum 60. For efficient heat exchange, the heat exchanging part 110 is provided with a ledge 112 protruding into the intake duct 70. Then, the air is discharged outside the cabinet 50 through the vent 54 via the exhaust duct 80 by the exhaust fan 82.

The drum 60 has a cylindrical shape and is opened at front and rear sides thereof. The drum 60 is installed on the support panel 62 which has a through-hole 62*a* formed therein. The through-hole 62*a* is coupled to the intake duct 70. After being heated by the heater 74, air flows into the drum 60 through the intake duct 70. A front panel 64 is disposed between the front side of the drum 60 and an opening of the cabinet 50, and has a discharge port 64*a* formed at a lower side of the front panel 64. The discharge port 64*a* is connected with an extension tube 84 extending toward the ventilation fan 82. A housing 86 is disposed between the extension tube 84 and the exhaust duct 80 to accommodate the ventilation fan 82 such that the ventilation fan 82 can rotate inside the housing 86.

The intake duct 70 extends from a lower end of the cabinet 50 to a rear upper portion of the cabinet 50 corresponding to the through-hole 62*a*, and has a suction hole 72 formed at the lower end of the intake duct 70 and a supply hole 76 formed at the upper end thereof to be inserted into the through-hole 62*a*. With this configuration, air flowing from the interior of the cabinet 50 into the intake duct 70 through the suction hole 72 can be heated while passing through the heater 100. Then, the heated air moves to the upper side of the cabinet 50 along the intake duct 70 and flows into the drum 60 via the supply hole 76 and the through-hole 62*a*. The drum 60 connected to the drive motor 90 via a belt 96 is rotated while the laundry is dried or sterilized therein.

Further, at least one side of the intake duct 70 protrudes towards the rear side of the cabinet 50, the suction hole 72 is in communication with the interior of the cabinet 50, and the supply hole 76 is inserted into the cabinet 50 to communicate with the through-hole 62*a*. Since the heater 74 is provided inside the intake duct 70 disposed on the outer side of the cabinet 50, the distance between the heater 74 and the drum 60 becomes shorter than that of the conventional dryer in which the heater 74 is provided at the lower side of the cabinet 50. Therefore, the dryer according to this embodiment can prevent air heated to a predetermined temperature or more by the heater 74 from undergoing thermal loss while the air flows along the intake duct 70, so that operating efficiency of the dryer can be improved. Furthermore, the heater 74 is located at the outer side of the cabinet 50 that defines a different space from that of the drive motor 90, which is likely to overheat, so that the interior of the cabinet 50 can be prevented from overheating, thereby preventing malfunction or damage of the dryer caused by overheating of the drive motor 90.

The heat exchanging part 110 includes the ledge 112 formed into the intake duct 70. The ledge 112 may define a space between the intake duct 70 and the support panel 62. When air heated by the heater 74 flows towards the supply hole 76, it comes into contact with the ledge 112, transferring heat to the ledge 112.

The support panel 62 is formed with a conduction hole 114 so as to correspond to the ledge 112. The air having been introduced into a space defined between the ledge 112 and the support panel 62 through the conduction hole 114 contacts the ledge 62 and is heated, so that heat of the heated air can be transferred to the interior of the drum 60.

One end of the heat exchanging part 110 is disposed adjacent the other end of the heater 74. Accordingly, since the heat exchanging part 110 is not directly heated by the heater 74, the aforementioned configuration prevents thermal energy from being excessively supplied from the heater 74 into the drum 60 through the heat exchanging part 110. Specifically, a lower end of the heat exchanging part 110 is disposed adjacent an upper end of the heater 60 so as not to overlap with each other. Hence, after being heated by the heater 60, air comes into contact with the ledge 112 of the heat exchanging part 110 in a state that the temperature of the air is lowered by a predetermined degree while flowing upward, so that thermal energy of a proper temperature can be transferred into the drum 60 through the heat exchanging part 112.

Further, the one end of the heat exchanging part 110 and the other end of the heater may be disposed in parallel. For example, the lower end of the heat exchanging part 110 and the upper end of the heater 74 may be disposed to have substantially the same height. When the heater 74 is disposed lower than the heat exchanging part 110, it is possible to prevent the interior of the drum 60 from overheating and to prevent thermal loss of air heated by the heater 60. Thus, air, which is heated while passing through the heater 74, is reduced in temperature by a predetermined degree while flowing upward, and comes into contact with the ledge 112, thereby transferring heat from the air to the ledge 112.

Further, according to one embodiment of the present invention, the dryer further includes a cooling hole 120 formed between the heater 74 and the heat exchanging part 110 to supply air outside the intake duct 70 into the intake duct 70 therethrough. With this configuration, air outside the intake duct 70 can be introduced into the intake duct 70 through a space between the support panel 62 and the intake duct 70 via the cooling hole 120 without contacting the heater 74. Here, the cooling hole 120 may be located above the heater 74. The air introduced into the intake duct 70 through the cooling hole 120 does not directly contact the heater 74 but contacts air heated by the heater 74, thereby lowering the temperature of the heated air by a predetermined degree. By this operation, the temperature of air supplied into the drum 60 is lowered by a predetermined degree, so that the laundry can be prevented from being damaged. That is, according to this embodiment, the air heated by the heater 74 can be introduced into the drum 60 after being mixed with the air having passed through the cooling hole, thereby preventing excessively heated air from being supplied into the drum 60.

Now, operation of the dryer including the heater integrated intake duct according to one embodiment of the present invention will be described below.

Figure 7:
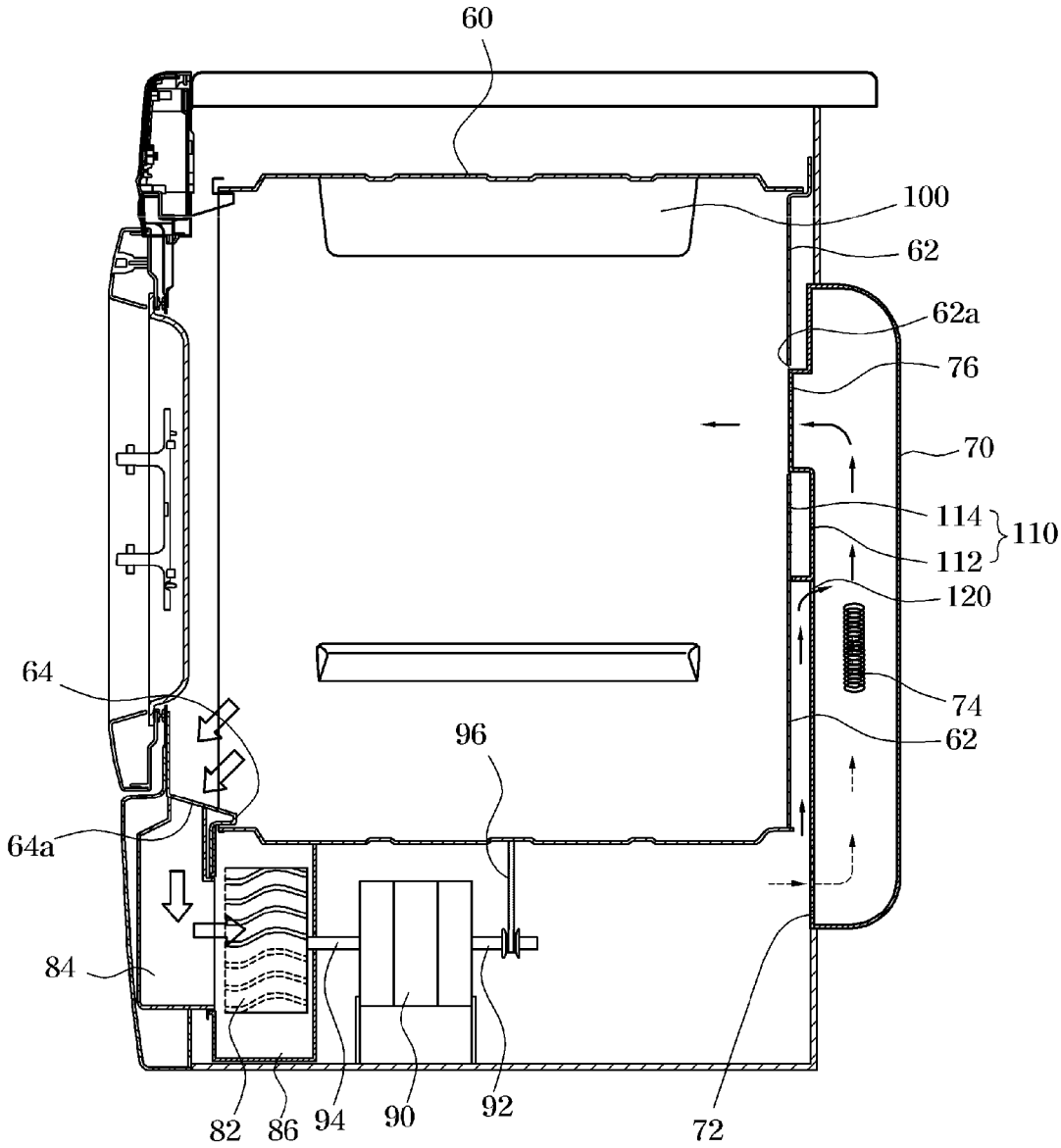
FIG. 7 is a side section view of the dryer including an intake duct according to one embodiment of the present invention.
Figure 8:
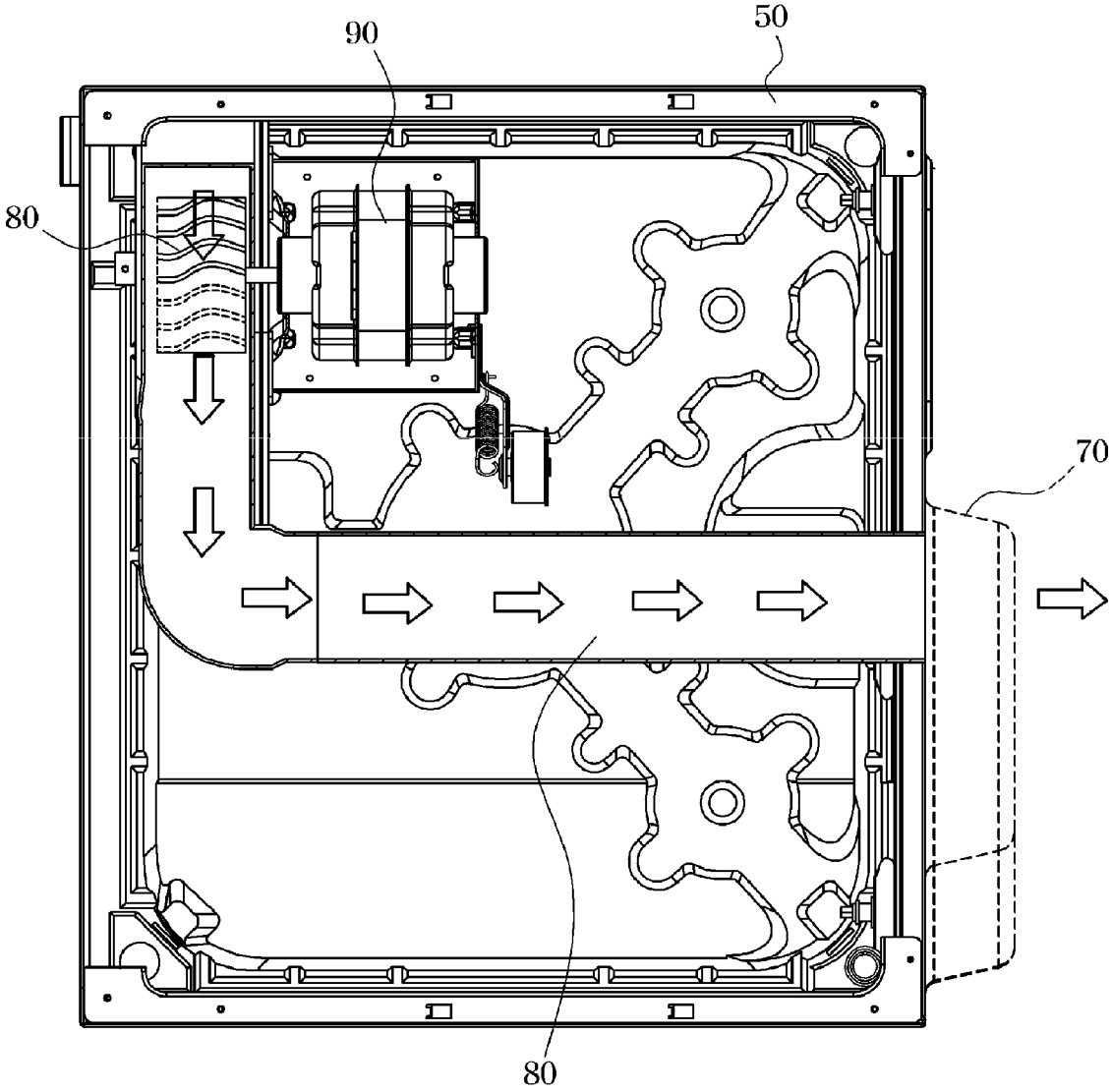
FIG. 8 is a plan view of an exhaust passage of the dryer according to one embodiment of the present invention.

FIG. 7 is a side section view of the dryer including an intake duct according to one embodiment of the present invention, and FIG. 8 is a plan view of an exhaust passage of the dryer according to one embodiment of the present invention.

Referring to FIGS. 4 and 6 to 8, when power is applied to the drive motor 90 and the heater 74 to drive the ventilation fan 82 and the drum 60, air inside the cabinet 50 is introduced into the drum 60 through the intake duct 70. While flowing into the drum 60, the air flows toward the upper side of the cabinet 50 through the intake duct 70 which extends in the vertical direction on the rear side of the cabinet 50, and is heated by the heater 100. Then, heated air is supplied into the drum 60 through the supply hole 76 and the through-hole 62*a* to dry or sterilize laundry accommodated in the drum 60. At this time, the heated air having passed through the heater 74 contacts the ledge 112 to thereby transfer heat from the air to the ledge 112, which in turn contacts air introduced into the intake duct 70 through the conduction hole 114, so that the heat is transfer to air inside the drum 60. Accordingly, it is possible to reduce loss of thermal energy, which can occur when air passed through the heater 74 flows toward the supply hole 76.

Further, when air is introduced into the intake duct 70 through the gap between the support panel 62 and the intake duct 70, it passes through the cooling hole 120 and contacts the heated air, thereby lowering the temperature of air supplied into the drum 60 by a predetermined degree. Accordingly, hot air heated by the heater 74 can be prevented from experiencing thermal loss until it is supplied into the drum 60, thereby permitting an efficient drying operation of the dryer. Also, if air is excessively overheated by the heater, the air is supplied into the drum 60 after the temperature of the air is lowered by a predetermined temperature by the air introduced through the cooling hole 120. By this operation, since the excessively heated air can be prevented from being supplied into the drum, it is possible to prevent damage of the laundry or components of the dryer.

When introduced into the drum 60 through the through-hole 62*a*, the heated air dries the laundry as a vortex to perform the drying operation inside the drum. After the drying operation, the air is discharged outside the drum 60 through the discharge port 64*a*. Then, the discharged air flows into the housing 86 of the ventilation fan 82 through the extension tube 84 communicating with the discharge port 64*a* and is exhausted from the cabinet 50 through the air vent 54 via the exhaust duct 80.

As apparent from the above description, in the dryer according to the present invention, an intake duct having a heater disposed therein is located on an outer lateral side of a cabinet that defines a different space from that for a drive motor, which is likely to overheat, thereby preventing the dryer from excessively overheating.

In addition, according to the present invention, the dryer includes a heat exchanging part to transfer thermal energy from the heater into the drum to improve thermal efficiency, and a cooling hole to prevent the heater, the intake duct and the interior of the drum from overheating, thereby reducing time and electric energy for the drying operation while preventing malfunction and damage of the dryer during the operation.

Further, according to the present invention, one end of the heat exchanging part is located near the other end of the heater and a cooling hole is formed between the heat exchanging part and the heater to prevent heat from being excessively supplied from the heater into the drum in order to prevent damage of laundry while improving a heat transfer rate, thereby securing stable operation of the dryer while reducing operation costs of the dryer.

Although the present invention has been described with reference to the embodiments and the accompanying drawings, these are given by way of illustration only, and, it will be apparent to those skilled in the art that various modifications and other equivalent embodiments can be made without departing from the scope of the present invention. In addition, although the present invention has been described with reference to the dryer having the heater-integrated intake duct as specifically disclosed herein, it should be noted that the dryer has been illustrated as an example, and that the heater-integrated intake duct of the present invention may be applied to other products without being limited to the heater-integrated intake duct for the dryer. Therefore, the scope and spirit of the invention is limited only by the claims set forth herein as follows.

What is claimed is:

1. A dryer having a heater-integrated intake duct, comprising:

a support panel having a through-hole;

an intake duct having a supply hole configured to communicate with the through-hole, the intake duct disposed on a rear surface of the support panel;

a drum into which air flows via the through-hole, the drum supported on the support panel;

a heater disposed inside the intake duct to heat the air flowing into the drum; and a heat exchanging part provided on the intake duct, the heat exchanging part configured to transfer heat of the heated air into the drum, wherein the heat exchanging part comprises a ledge disposed at the supply hole and configured to protrude into the intake duct, the ledge defining a space between a front surface of the intake duct and the rear surface of the support panel, and the heat exchanging part further comprises a conduction hole formed in the support panel so as to correspond to the ledge.

2. The dryer according to claim 1, further comprising:

a cooling hole formed between the heater and the heat exchanging part to allow air outside the intake duct to be supplied into the drum through the cooling hole.

3. The dryer according to claim 1, wherein one end of the heat exchanging part is disposed adjacent the other end of the heater.

4. The dryer according to claim 3, wherein the one end of the heat exchanging part is disposed parallel to the other end of the heater.

5. The dryer according to claim 1, wherein one side of the intake duct is disposed outside the cabinet.

6. The dryer according to claim 5, wherein the one side of the intake duct is disposed on a lateral side of the cabinet.

7. The dryer according to claim 1, wherein the heater is disposed on a lateral side of the cabinet.

8. The dryer according to claim 7, further comprising:

a drive motor provided at a lower side of the cabinet.

* * * * *